US005809485A

United States Patent [19]

Arsenault et al.

[11] Patent Number: 5,809,485

[45] Date of Patent: Sep. 15, 1998

[54] METHOD AND APPARATUS FOR AUTOMATICALLY DISABLING A REMOVABLE, PORTABLE VAULT OF A POSTAGE METERING

[75] Inventors: Robert G. Arsenault, Stratford; Paul A. Diel, Fairfield; Dale A. French, Clinton; Joseph M. Mozdzer, Beacon Falls; Steven J. Shapiro, Monroe, all of Conn.

[73] Assignee: Pitney Bowes, Inc., Stamford, Conn.

[21] Appl. No.: 764,398

[22] Filed: Dec. 11, 1996

[51] Int. Cl.[6] ..... G07B 17/00

[52] U.S. Cl. ..... 705/410; 235/375; 340/825.3; 340/825.34

[58] Field of Search ..... 235/375, 380, 235/381, 382; 340/825.3, 825.31, 825.34, 825.35; 364/464.11, 464.2; 705/401, 410

[56] References Cited

U.S. PATENT DOCUMENTS

| | | | |
|---|---|---|---|
| 4,802,218 | 1/1989 | Wright et al. | 235/375 X |
| 4,812,994 | 3/1989 | Taylor et al. | 340/825.31 X |
| 4,813,912 | 3/1989 | Chickneas et al. | 235/375 X |
| 4,980,542 | 12/1990 | Jackson et al. | 235/375 |
| 5,111,030 | 5/1992 | Brasington et al. | 235/375 |
| 5,490,077 | 2/1996 | Freytag | 364/464.15 |
| 5,585,613 | 12/1996 | Bell et al. | 235/101 |
| 5,602,743 | 2/1997 | Freytag | 364/464.18 |

*Primary Examiner*—Edward R. Cosimano
*Attorney, Agent, or Firm*—Steven J. Shapiro; Melvin J. Scolnick

[57] ABSTRACT

A postage metering system includes a portable postage meter vault; structure for printing an indication of postage value; a postage meter terminal including apparatus for receiving the portable postage meter vault, a device for determining at times when the portable postage meter vault is inserted into the receiving means if the portable postage meter vault has been designated to be disabled from performing vault functions and a device for automatically disabling the portable postage meter vault from performing vault functions if the determination is made that the portable postage meter vault has been designated to be disabled from performing vault functions. A method for disabling a portable vault of a postage metering system includes the steps of: (A) inserting the portable vault into a terminal of the postage metering system; automatically determining via the terminal if the portable vault has been designated to be disabled from performing vault functions; and (C) at times when in step (B) it is determined that the portable vault has been designated to be disabled from performing vault functions automatically disabling the inserted portable vault from performing vault functions.

19 Claims, 2 Drawing Sheets

METHOD AND APPARATUS FOR AUTOMATICALLY DISABLING A REMOVABLE, PORTABLE VAULT OF A POSTAGE METERING

BACKGROUND

This invention relates to a postage metering system which utilizes a removable accounting vault and more particularly to a method and apparatus for automatically disabling operation of the remote accounting vault.

Postage metering systems are well known and typically include a keyboard, display, accounting circuitry, and a printing mechanism. The keyboard and display jointly operate to permit communication between the postage meter operator and the postage meter itself in order to identify the amount of postage to be dispensed. The accounting circuitry includes a plurality of registers which serve the purposes of keeping track of the amount of available postage remaining in the postage meter and for deducting the amount of postage dispensed for an individual postage transaction from the amount of postage that is available. Additional accounting circuitry registers are used to identify the total amount of postage which has been added to the postage meter over its life as well as the total amount of postage dispensed over the life of the meter.

Conventional postage meters are also capable of communicating with a remote data center via a modem and telephone line in order to recharge the funds in the meter. That is, by communicating in a secure manner with the remote data center, additional funds can be added to the meter at the discretion of the meter user. Moreover, the same communication link with the data center can also be utilized to download zipcode information, withdraw funds from the meter and to obtain critical inspection data from the meter for subsequent analysis concerning meter performance or to ascertain whether fraudulent attempts to tamper with the meter have occurred.

In a large majority of conventional postage meters the accounting circuitry, the keyboard and display, and the printing mechanism are all integrated within a single housing to define a self-contained postage meter unit. Accordingly, when a customer no longer requires the use of the meter, a customer service representative of the postage meter manufacturer has to be sent to the user site and uses specialized codes to withdraw funds from the meter. Subsequent to the withdrawal of funds from the meter, the customer service representative returns the postage meter to the postal authority to officially withdraw the meter from service. The postal authority then reimburses the customer for the funds that were withdrawn and not utilized. The postal authority also reinitializes the meter so that it can subsequently be issued for use by another user.

The procedure set forth above requires a great amount of manual handling of the meter, is very time consuming, and necessitates an extensive tracking system for every meter. In order to overcome some of the problems associated with the return of a meter, copending U.S. patent application Ser. No. 08/701,946 filed Aug. 23, 1996 and entitled "APPARATUS AND METHOD FOR ELECTRONIC DEBITING OF FUNDS FROM A POSTAGE METER", which is hereby incorporated by reference, describes a method and apparatus for utilizing the remote data center communications link to securely withdraw all of the funds from the postage meter thereby eliminating the need for the customer service representative. However, since the physical postage meter must still be sent back to the post office a significant amount of manual tracking of the meter is still required.

U.S. Pat. No. 4,802,218 issued to Wright, et al. describes a postage metering system which utilizes a portable external accounting vault. In the Wright structure the accounting circuitry is not securely contained within the main housing of the postage meter, but is an external card vault which is insertable into a card reader slot contained within the housing of the postage metering system. The user card has its own microprocessor and associated memories which permit it to communicate with the rest of the postage meter including the display, the keyboard and printing mechanism, via the card reader. Thus the user card performs all of the accounting functions discussed above such that when the user card vault is removed from the housing the remaining portion of the metering system is not capable of functioning to dispense postage.

By incorporating the accounting circuitry of the postage meter in a portable user card vault a great deal of flexibility is provided to the user of the total metering system. That is, a single base terminal having only a printing and display function therein can now be accessed by a plurality of individual card vault users for dispensing postage while ensuring that only the card which is inserted into the card reader accounts for that specific postage dispensed. Accordingly, in a single company with a multitude of departments, each department can be given a user card accounting vault which would keep track of the amount of postage when it is dispensed by that department each time the respective card vault is used. Additionally, base terminals could be placed at various locations in the community such as, for example, a grocery store and individual users could have their own respective user card vaults for insertion into the base terminal to permit printing of a postage indicia on their mailpieces. This metering system provides the flexibility of individual accounting but only requires the use of a single metering transaction terminal. Accordingly, instead of having a large cost associated with a single self contained postage meter, inexpensive user card vaults could be obtained and used by a plurality of individual users in the single transaction terminal. Thus, the overall cost for the metering system is greatly reduced. Moreover, since the single transaction terminal of the metering system does not have any accounting data contained therein there is no reason why the transaction terminals need to be accounted for by the postal service. In this configuration only the individual smart card vaults are of any real interest to the postal service since that is where the postage funds are contained. It is quite obvious that the physical handling and shipping of a user card vault is much simpler and can be done more economically than if the entire postage meter had to be returned to the post office. Furthermore, in the United States where meters can only be rented, the metering system terminal can now be a component which is procured by the user and only the individual smart card vaults would have to be rented and accounted for by the postal service.

While the above flexibility provides a significant advantage to a multi-departmental company and supports the concept of having publicly available transaction terminals which can accommodate individual user card vaults, it does present other user related problems. For example, the problem discussed above with respect to the stand alone postage meter still exists to some extent in that if a user no longer requires the user card vault they still must return it to the post office so that it is fully accounted for. Moreover, in the situation where an individual user's postage meter card vault is lost or stolen it can be used by anybody who has access to the terminal of the postage metering system to dispense whatever postage remains in the individual user card vault.

While the use of personal identification numbers associated with each user card vault will help to prevent its use by an unauthorized possessor of the card, this clearly is not a fully sufficient protective feature.

SUMMARY OF THE INVENTION

It is an object of the instant invention to provide a method and apparatus for automatically disabling a removable, portable vault of a postage metering system subsequent to that specific removable, portable vault being identified as lost or stolen or as no longer being required by the user.

It is a further object of the instant invention to provide a method and apparatus for disabling a removable, portable, vault of a postage metering system so that the removable, portable vault can be discarded by the user and considered destroyed by the respective postal service.

The above objects are met by providing a postage metering system including a portable postage meter vault; structure for printing an indication of postage value; a postage meter terminal including apparatus for receiving the portable postage meter vault, a device for determining at times when the portable postage meter vault is inserted into the receiving means if the portable postage meter vault has been designated to be disabled from performing vault functions and a device for automatically disabling the portable postage meter vault from performing vault functions if the determination is made that the portable postage meter vault has been designated to be disabled from performing vault functions and by providing a method for disabling a portable vault of a postage metering system includes the steps of: (A) inserting the portable vault into a terminal of the postage metering system; automatically determining via the terminal if the portable vault has been designated to be disabled from performing vault functions; and (C) at times when in step (B) it is determined that the portable vault has been designated to be disabled from performing vault functions automatically disabling the inserted portable vault from performing vault functions.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
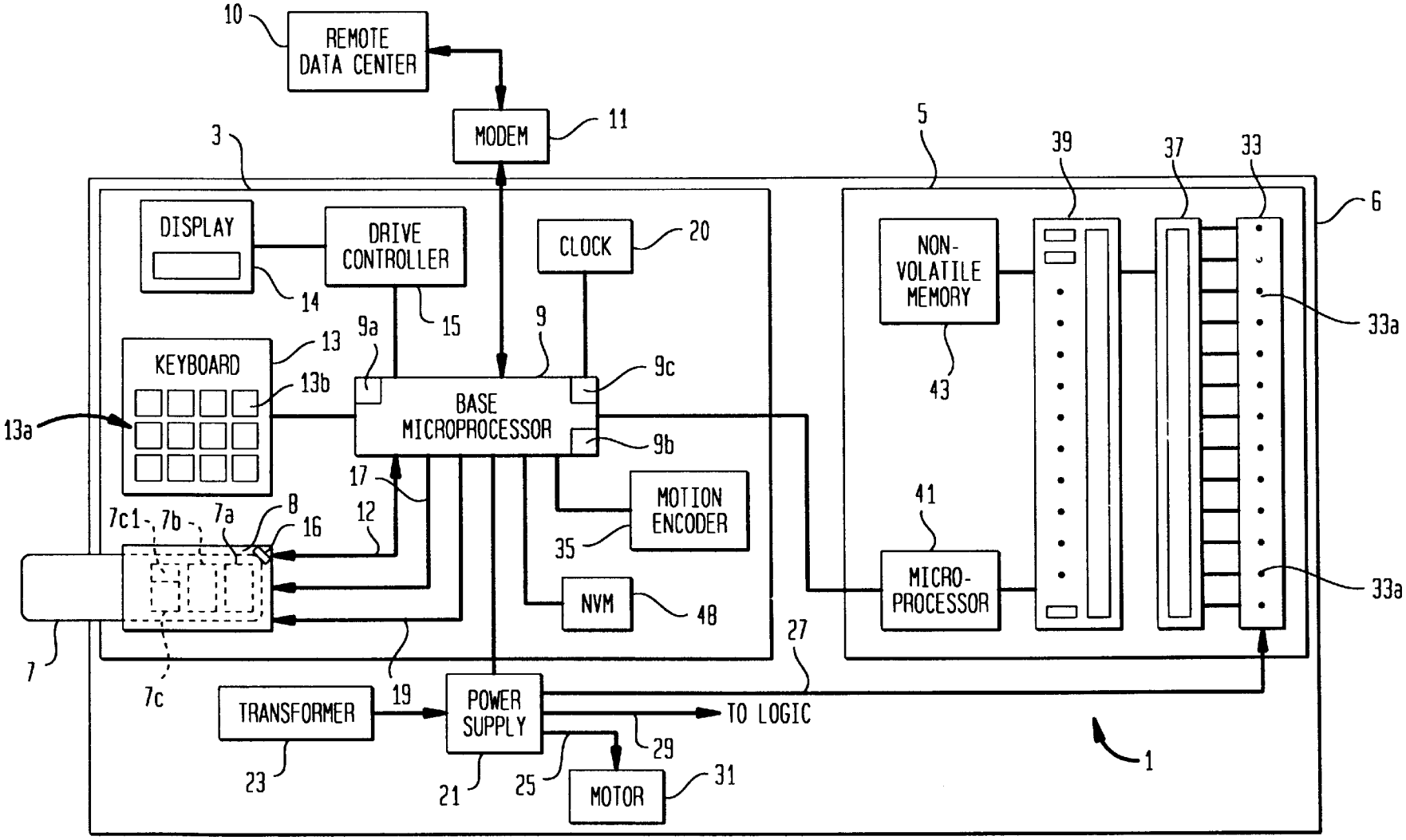
FIG. 1 is a schematic electrical block diagram of a postage meter incorporating the instant invention.

Referring to FIG. 1, postage meter 1 includes two primary modules, a base module 3 and a printhead module 5 each of which are contained within a housing defining a single transaction terminal 6. Base module 3 includes a smart card reader 8 which receives a removable smart card vault 7, and a transaction or base microprocessor 9. Smart card vault 7 has a central processing unit 7*a,* RAM 7*b,* and non-volatile memory (NVM) 7*c* which together with the operating programs stored in NVM 7*c* allow the smart card vault 7 to perform the accounting functions of postage meter 1. That is, smart card vault 7 has the capability to have securely downloaded therein, from a remote data center 10, a predetermined amount of postage funds by securely communicating with data center 10 via a modem 11 and transaction microprocessor 9. Furthermore, during each postage transaction, smart card vault 7 checks to see if sufficient funds are available. If sufficient funds are available, smart card vault 7 debits the amount from a descending register, adds the amount to an ascending register, and sends the postage amount to the printhead module 5 via the transaction microprocessor 9. The ascending and descending registers while not shown are within NVM 7*c*. Transaction microprocessor 9 also sends the date data to the printhead module 5 so that a conventional postal indicia image can be printed on a mailpiece.

Smart card vault 7 thus manages the postage funds with the ascending register representing the lifetime amount of postage funds spent, the descending register representing the amount of funds currently available, and a control sum register representing the running total amount of funds which have been credited to smart card vault 7. Additional features of smart card vault 7 which can be included are a piece counter register, encryption algorithms for encoding the information sent to the printhead module 5, and software for requiring a user to input a personal identification number which must be verified by the vault microprocessor 7 prior to its authorizing a postage transaction.

Transaction microprocessor 9 acts as a traffic cop in coordinating and assisting in the transfer of information along data line 12 between the vault microprocessor 7 and the printhead module 5, as well as coordinating various support functions necessary to complete the metering function. Transaction microprocessor 9 includes RAM 9*a,* ROM 9*b,* and central processing unit 9*c* to provide for the effective execution of meter operating programs stored in ROM 9*b* to accomplish the meter coordinating functions discussed above. Transaction microprocessor 9 also interacts with keyboard 13 to transfer user information input through keyboard keys 13*a* (such as PIN number, postage amount) to smart card vault 7. Additionally, transaction microprocessor 9 sends data to a liquid crystal display 14 via a driver/controller 15 for the purpose of displaying user inputs or for prompting the user for additional inputs. Moreover, base microprocessor 9 provides power and a reset signal to vault microprocessor 7 via respective lines 17, 19 upon detection of the insertion of smart card vault 7 into card reader 8 by a conventional electrical switch 16. A clock 20 provides date and time information to transaction microprocessor 9. Alternatively, clock 20 can be eliminated and the clock function can be accomplished by the transaction microprocessor 9.

Postage meter 1 also includes a conventional power supply 21 which conditions raw A.C. voltages from a wall mounted transformer 23 to provide the required regulated and unregulated D.C. voltages for the postage meter 1. Voltages are output via lines 25, 27, and 29 to a printhead motor 31, printhead 33 and all logic circuits. Motor 31 is used to control the movement of the printhead relative to the mailpiece upon which an indicia is to be printed. Base microprocessor 9 controls the supply of power to motor 31 to ensure the proper starting and stopping of printhead 33 movement after smart card vault 7 authorizes a transaction.

Base module 3 also includes a motion encoder 35 that processes the movement of the printhead motor 31 so that the exact position of printhead 33 can be determined. Signals from motion encoder 35 are sent to printhead module 5 to coordinate the energizing of individual printhead elements 33*a* in printhead 33 with the positioning of printhead 33. Alternatively, motion encoder 35 can be eliminated and the pulses applied to stepper motor 31 can be counted to determine the location of printhead 33 and to coordinate energizing of printhead elements 33*a*.

Printhead module 5 includes printhead 33, a printhead driver 37, a drawing engine 39 (which can be a microprocessor or an Application Specific Integrated Circuit (ASIC)), a microprocessor 41 and a non-volatile memory 43. NVM 43 has stored therein image data of the fixed indicia and image data for each individual font that can be required as part of the variable data. Microprocessor 41 receives a print command, postage amount, and date via the transaction microprocessor 9. The postage amount and date are sent from microprocessor 41 to the drawing engine 39 which then accesses non-volatile memory 43 to obtain image data therefrom which is then downloaded by the drawing engine 39 to the printhead driver 37 in order to energize individual printhead elements 33*a* to produce a single column dot pattern of the indicia. The individual column-by-column generation of the indicia is synchronized with movement of printhead 33 until the full indicia is produced.

As previously discussed, there are two significant drawbacks in using a removable, portable accounting device in a metering system. The first is that when a user no longer has a need for the metering system the accounting device must be turned in to the postal authority and its whereabouts tracked until it is properly disposed of. The second drawback occurs where the portable accounting device is either lost or stolen. If either of these events occurs, anyone possessing the portable vault can use it in any compatable metering terminal to dispense whatever value of postage remains in the portable accounting device. When this occurs, either the user will lose the value of the postage illegally dispensed, the postal authority will not obtain the revenue from such postage, or the meter manufacturer will have to reimburse the user, depending on the governmental and/or business policies regarding lost and stolen portable accounting devices.

Figure 2:
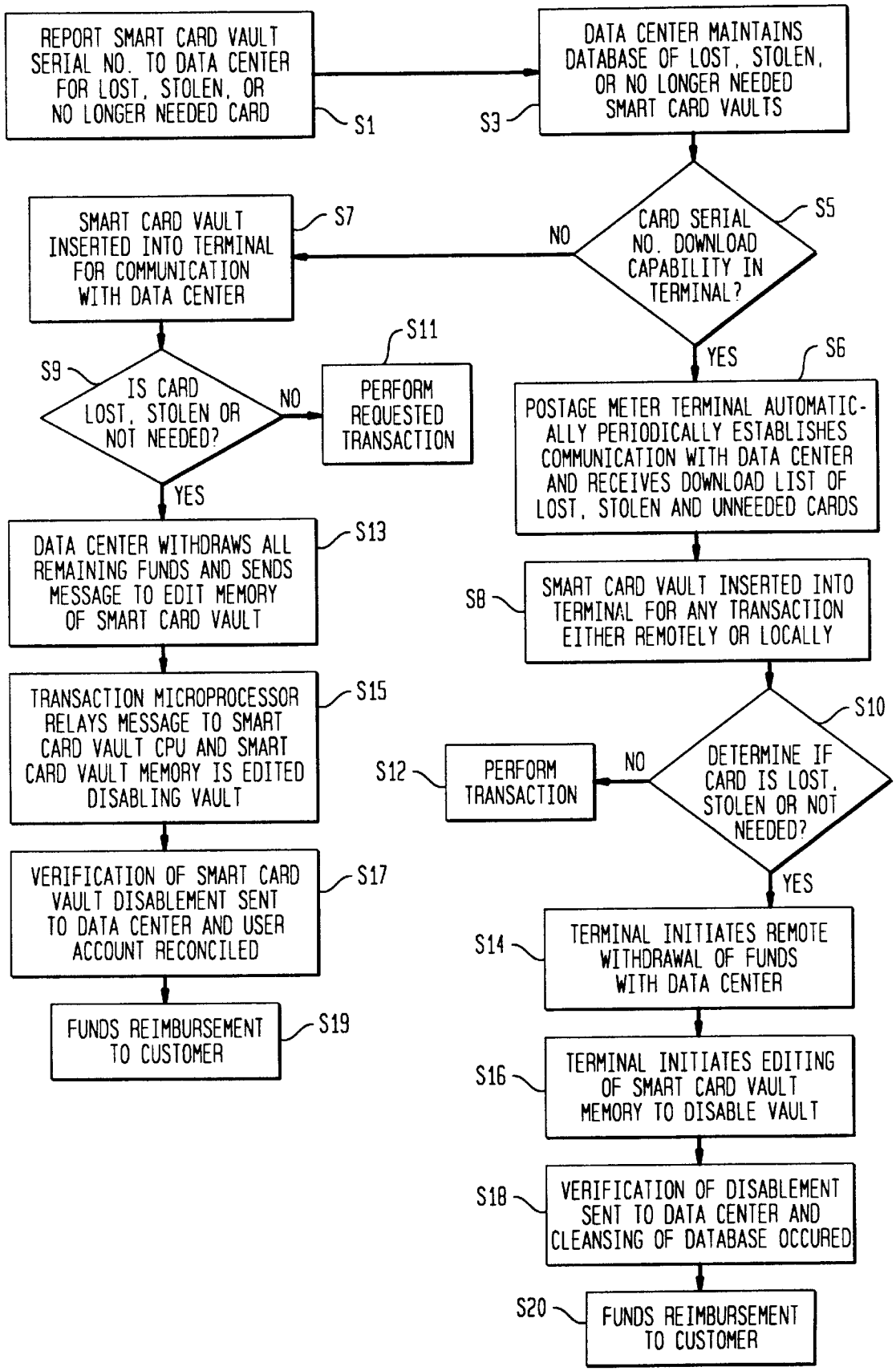
FIG. 2 is a flow chart of the inventive method for disabling a portable postage meter vault.

In order to overcome the problems set forth above, the instant invention makes use of the communications link between postage meter 1 and data center 10 to disable smart card vault 7 from operating as an authorized vault subsequent to smart card vault 7 being reported as having been lost, stolen, or as no longer needed by the user. Referring to FIGS. 1 and 2, the inventive disabling of smart card vault 7 will hereinafter be described. At step S1, a postage meter user reports to data center 10 the serial number (or other identifier) of a specific smart card vault 7 together with information as to whether the specific smart card vault 7 has been lost, stolen, or is no longer needed by the user. This information can be conveyed by a manual operation whereby a user places a telephone call to the data center and verbally provides the information or it can be accomplished via the postage meter 1. That is, one of the keyboard buttons 13*b* can be designated for this specific reporting purpose. If the designated button is pressed by the user, the postage meter 1 through programming in transaction microprocessor 9 1) requests that the user enter the serial number of the smart card vault 7 and an indication of whether the smart card vault 7 is lost, stolen, or no longer needed, 2) dials the data center 10 to establish a communication link with data center 10, and 3) sends a message to the data center 10 identifying the serial number of the smart card vault 7 and whether it is lost, stolen, or no longer needed. The identification of whether the smart card vault 7 is lost, stolen or no longer needed can be tied to a keyboard input with a different keyboard button associated with each situation. Alternatively, for the situation where a smart card vault 7 is no longer needed, and that smart card vault 7 is inserted into the card reader 8 and detected by switch 16, the serial number which is stored in NVM 7*c* is automatically downloaded to data center 10 without requiring the operator to input such serial number. In any event, once the data center 10 has received the serial number and card disposition, it stores this information in a data base which is categorized to list lost, stolen, no longer needed, authorized and disabled smart card vaults 7 (step S3).

Subsequently in step S5, the next time the reported lost, stolen or no longer needed card is inserted into the postage meter 1 for any meter transaction, one of two things can occur. First, if the postage metering terminal 6 is of the type that has ample memory for having downloaded therein from the data center 10 the lists of stolen, lost, or no longer needed cards, the postage meter terminal 6 is programmed via terminal microprocessor 9 to perform step S6 as will be discussed in more detail below. However, if postage meter terminal 6 does not have ample memory to accommodate such a data download, and smart card vault 7 has been inserted into card reader 8 for the purpose of any type of communication with data center 10 such as to refill smart card vault 7, or to inspect smart card vault 7 (step S7), transaction microprocessor 9 establishes communication with data center 10 in a conventional manner by identifying the serial number of the inserted smart card vault 7. Data center 10, prior to performing the requested transaction, checks its vault data base to determine in Step S9 if the inserted smart card vault 7 has been reported as lost, stolen, or no longer needed. If the answer to the inquiry is NO, the requested postage meter transaction is performed (step S11). However, if the answer to the inquiry in Step S9 is YES, the data center 10 automatically performs a withdrawal of all postage funds remaining in the inserted smart card vault 7 in accordance with the procedure set forth in the aforementioned copending patent application Ser. No. 08/701,946 (step S13). Subsequent to verification of a successful funds withdrawal, data center 10 sends a message (in either plain text or encrypted form) to transaction microprocessor 9 to edit a portion of NVM 7*c* of smart card vault 7 to disable smart card vault 7 from functioning as a postage meter vault (step S13). The transaction microprocessor sends the disabling message to CPU 7*a* which in turn performs the editing function (Step 15). The editing function can be as simple as setting a flag. Moreover, in order to protect against the flag being reset, the portion 7*c*1 of NVM 7*c* being edited can be such that it can only be written over once. Additionally, the programming in transaction microprocessor 9 can be such that it will only accept a single edit instruction one time and only for the purpose of setting the flag to disable the smart card vault 7 from operating as a meter vault. Thus, the setting of the flag is a one-way operation effectively permanently disabling the smart card vault 7 from further use as a meter. In step S17, an encrypted message can be sent back to data center 10 verifying that the smart card vault 7 has been disabled so that the user account can be finally reconciled and the smart card vault data base updated to identify the disabled status of postage meter vault 7. Finally, any reimbursement due the legal user of the smart card vault 7 can be sent from the data center 10 to the user in either a manual or automated operation (step S 19).

It should be noted that the telephone connection between data center 10 and postage meter 1 is susceptible to being lost prior to the completion of verification step S17. If this occurs, the data center will not know whether card disablement has occured. Accordingly, during disabling of the smart card vault 7 at step S15, the ability of smart card vault 7 to establish a communications link with data center 10 and to provide its serial umber thereto remains in effect even though all metering functions have been disabled. Thus, in the event the telephone connection is lost prior to verification, a disabling verification message will automatically be sent to the data center 10 upon reinsertion of the disabled smart card vault 7 into card reader 8 and reestablishment of a communications link with data center 10.

The structure and method described above for a postage meter terminal 6 which doesn't have sufficient memory to have downloaded therein the status list of all smart card vaults 7 is effectively used to remotely disable a smart card vault 7 subsequent to its being reported as being lost, stolen, or no longer needed. Moreover, any funds remaining in the smart card vault 7 can be reclaimed by the data center. However, in the system described above, it is necessary for the user of the lost, stolen, or no longer needed smart card vault 7 to initiate communication with the data center 10 for the disablement and funds withdrawal to occur. In the situation where the smart card vault 10 has been lost or stolen and is being illegally used by another party, there is no way of preventing the funds remaining in the smart card vault 7 from being completely used up. That is, if the illegal user only inserts the smart card vault 7 into the terminal 6 for dispensing postage and does not establish a communications link with the data center 10, no remote disabling of smart card vault 7 will occur.

The above-described system is satisfactory for a low cost metering system. Moreover, in such a low cost system the effects of lost postage due to lost or stolen smart card vaults 7 can be minimized by limiting the amount of postage funds which are available in the smart card vault 7. However, the applicants have recognized that in larger metering systems where low cost is not the primary objective, the above-described limitations of the low cost system can be overcome by adding additional NVM 48 to terminal 6. That is, referring to step S5 of FIG. 2, if NVM 48 is available in terminal 6, the system is capable of having downloaded therein from data center 10 the list of lost, stolen, and no longer needed smart card vaults 7. In step S6, via programming in transaction microprocessor 9, transaction terminal 6 automatically on any desired periodic basis (such as daily) dials into data center 10 via modem 11 and establishes a communications link therewith. In response, data center 10 downloads the updated smart card vault 7 lists into NVM 48. Thus, when any smart card vault 7 is inserted into terminal 6 for any transaction, including the dispensing of postage or for communication with data center 10 (step S8), the transaction terminal obtains the card serial number from the smart card vault 7 and accesses the vault lists stored in NVM 48 to determine if the smart card vault 7 is lost, stolen, or no longer needed (step S10). In the event the smart card vault 7 is not lost, stolen or no longer needed, the requested postage transaction is performed (step S12). However, if the smart card vault is identified as being lost, stolen, or no longer needed, transaction microprocessor 9 automatically dials in and establishes communication with data base 10 and withdraws any remaining funds from smart card vault 7 (step s14). Subsequently, in step S16 editing of smart card vault 7, in the same manner as previously described, is accomplished to disable the smart card vault 7, in step S18 a verification of disablement message is sent to data center 10, and in step S20 fund reimbursement to the customer is accomplished (step S20).

The embodiment described immediately above permits a check of the status of any smart card vault 7 to be accomplished at the metering system terminal 6 so that any attempted use of a smart card vault 7 which has been reported as being lost or stolen or no longer needed will be prevented upon insertion of the vault into terminal 6. Thus, if a user promptly reports a lost or stolen card, the window of opportunity for illegal use of the lost or stolen card is greatly minimized.

While the instant invention has been described in connection with a postage meter, the invention is equally applicable to any type of value dispensing device where an item having an indication of value is dispensed and accounting for such value is accomplished. Moreover, while the preferred embodiment refers to a "smart card" vault, any type of removable, portable accounting device could be substituted therefor.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims.

What is claimed is:

1. A postage metering system comprising:

an authentic portable postage meter vault;

means for printing an indication of postage value;

a postage meter terminal including means for receiving the authentic portable postage meter vault, means for determining at times when the authentic portable postage meter vault is inserted into the receiving means if the authentic portable postage meter vault has been designated to be disabled from performing vault functions and means for automatically disabling the authentic portable postage meter vault from performing vault functions if the determination is made that the authentic portable postage meter vault has been designated to be disabled from performing vault functions.

2. A postage metering system as recited in claim 1, wherein the authentic portable postage meter vault is a smart card.

3. A postage metering system as recited in claim 1, wherein the determining means includes a microcontroller and means for storing a list of individual authentic portable postage meter vaults that have been designated to be disabled from performing vault functions, and the microcontroller communicates with the authentic portable postage meter vault inserted in the receiving means to obtain data specifically identifying the authentic portable postage meter vault inserted in the receiving means and accesses the storing means to determine if the authentic portable postage meter vault inserted in the receiving means has been designated to be disabled from performing vault functions.

4. A postage metering system as recited in claim 3, wherein the authentic portable postage meter vault includes a memory, the automatic disabling means includes a disabling program, and at times when the determining means determines that the authentic portable postage meter vault inserted in the receiving means has been designated to be disabled from performing vault functions the microcontroller executes the disabling program to edit the memory of the authentic portable postage meter vault thereby disabling the authentic portable postage meter vault from performing vault functions.

5. A postage metering system as recited in claim 1, further comprising a data center remotely located from the postage meter terminal and means for establishing a communications link between the data center and the postage meter terminal, and wherein the data center includes means for storing a list of individual authentic portable postage meter vaults that have been designated to be disabled from performing vault functions, and the determining means includes a microcontroller which communicates with the authentic portable postage meter vault inserted in the receiving means to receive data specifically identifying the authentic portable postage meter vault inserted in the receiving means and which accesses the storing means via the communications link to determine if the authentic portable postage meter vault inserted in the receiving means has been designated to be disabled from performing vault functions.

6. A postage metering system as recited in claim 5, wherein the authentic portable postage meter vault includes a memory, the automatic disabling means includes a disabling program, and at times when the determining means determines that the authentic portable postage meter vault inserted in the receiving means has been designated to be disabled from performing vault functions the microcontroller executes the disabling program to edit the memory of the authentic portable postage meter vault thereby disabling the authentic postage meter vault from performing vault functions.

7. A postage metering system as recited in claim 6, wherein the postage meter terminal further comprises means for automatically establishing the communications link with the data center each time the authentic portable postage meter vault is inserted into the receiving means.

8. A postage metering system as recited in claim 1, further comprising a data center remotely located from the postage meter terminal and means for establishing a communications link between the data center and the postage meter terminal, wherein the determining means includes a memory and the data center includes means for storing a list of individual authentic portable postage meter vaults that have been designated to be disabled from performing vault functions and means for downloading the list of authentic portable postage meter vaults that have been designated to be disabled from performing vault functions via the communications link from the data center into the memory, and wherein the determining means accesses the list of authentic portable postage meters that have been designated to be disabled from performing vault functions stored in the memory to determine if the authentic postage meter vault inserted in the receiving means has been designated to be disabled from performing vault functions.

9. A postage metering system as recited in claim 8, wherein the postage meter terminal further includes means for automatically periodically establishing the communications link with the data center so that periodic updates of the list of authentic portable postage meter vaults that have been designated to be disabled from performing vault functions are downloaded from the data center into the postage meter terminal memory.

10. A postage metering system as recited in claim 9, wherein the authentic portable postage meter vault includes a vault memory, the automatic disabling means includes a disabling program, and at times when the determining means determines that the authentic portable postage meter vault inserted in the receiving means has been designated to be disabled from performing vault functions the automatic disabling means executes the disabling program to edit the vault memory of the authentic postage meter vault thereby disabling the authentic postage meter vault from performing vault functions.

11. A method for disabling an authentic portable vault of a postage metering system comprising the steps of:

(A) inserting the authentic portable vault into a terminal of the postage metering system;

(B) automatically determining via the terminal if the authentic portable vault has been designated to be disabled from performing vault functions; and (C) at times when in step (B) it is determined that the authentic portable vault has been designated to be disabled from performing vault functions automatically disabling the inserted authentic portable vault from performing vault functions.

12. A method as recited in claim 11, wherein during step (B) the terminal communicates with a remote data center to determine if the inserted authentic portable vault has been designated to be disabled from performing vault functions.

13. A method as recited in claim 11, further comprising the step of automatically withdrawing all funds stored in the inserted authentic portable vault subsequent to the inserted authentic portable vault being identified as being designated to be disabled from performing vault functions.

14. A method as recited in claim 13, further comprising the step of verifying that disabling of the inserted authentic portable vault has occurred.

15. A method as recited in claim 11, wherein during step (C) a memory portion of the authentic portable vault is edited to disable the authentic portable vault from performing vault functions.

16. A method as recited in claim 15, further comprising the step of downloading from a remote data center into a storage medium of the terminal a list of authentic portable vaults designated to be disabled from performing vault functions and determining from the stored downloaded list if the inserted authentic portable vault has been designated to be disabled from performing vault functions.

17. A method as recited in claim 16, further comprising the step of utilizing the terminal to automatically establish communication with the data center for downloading of the list of authentic portable vaults that have been designated to be disabled from printing.

18. A method as recited in claim 17, wherein the terminal periodically automatically establishes communication with the data center to have downloaded into the terminal periodic updated lists of authentic portable vaults that have been designated to be disabled from performing vault functions.

19. A method for disabling an authentic portable vault of a value dispensing apparatus comprising the steps of:

(A) inserting the authentic portable vault into a terminal of the value dispensing apparatus;

(B) automatically determining via the terminal if the authentic portable vault has been designated to be disabled from performing vault functions; and (C) at times when in step (B) it is determined that the authentic portable vault has been designated to be disabled from performing vault functions automatically disabling the inserted authentic portable vault from performing vault functions.

* * * * *